United States Patent [19]

Hauk et al.

[11] 4,392,527

[45] Jul. 12, 1983

[54] WATER WELL DEVELOPING SYSTEM

[75] Inventors: Ernest D. Hauk; William C. Addison, both of Yucca Valley, Calif.

[73] Assignee: Hawk Industries, Inc., Signal Hill, Calif.

[21] Appl. No.: 239,895

[22] Filed: Mar. 3, 1981

[51] Int. Cl.[3] ..... E21B 43/112

[52] U.S. Cl. ..... 166/55.2; 166/318; 166/311; 175/269

[58] Field of Search ..... 166/297, 298, 311, 318, 166/55.2, 55.3, 55.8, 318, 319, 320, 328, 171; 175/268, 269, 271, 237

[56] References Cited

U.S. PATENT DOCUMENTS

| | | | |
|---|---|---|---|
| 2,312,018 | 2/1943 | Beckman | 175/237 |
| 3,254,720 | 6/1966 | Huitt et al. | 175/269 |
| 4,182,418 | 1/1980 | Jannsen | 166/312 |
| 4,220,201 | 9/1980 | Hauk | 166/55.2 |

FOREIGN PATENT DOCUMENTS

| | | | |
|---|---|---|---|
| 271638 | 3/1914 | Fed. Rep. of Germany | 166/55.8 |

*Primary Examiner*—James A. Leppink
*Assistant Examiner*—Hoang C. Dang
*Attorney, Agent, or Firm*—Gausewitz, Carr, Rothenberg & Edwards

[57] ABSTRACT

A water well developer is connected between the end of a hollow drill string and an air-actuated well casing perforator to allow air under pressure to be transmitted through the developer to the perforator. After completion of the perforation, and without removing the perforating tool, a ball is dropped down the hollow drill string to block a passage through a piston that is slidably mounted in the developer, causing the piston to be driven downwardly and to unblock ports through which jets of air are driven into the interior of the casing. As the developer piston is driven down it also completes a relief passage connection that dumps air or water from the perforator.

5 Claims, 5 Drawing Figures

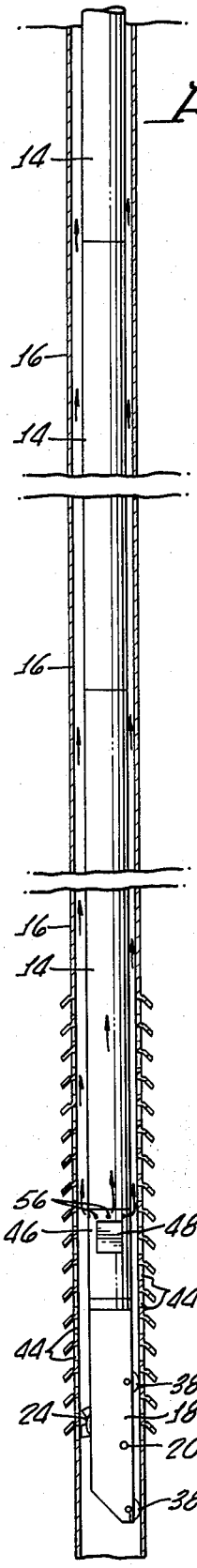
FIG. 5.
FIG. 3.
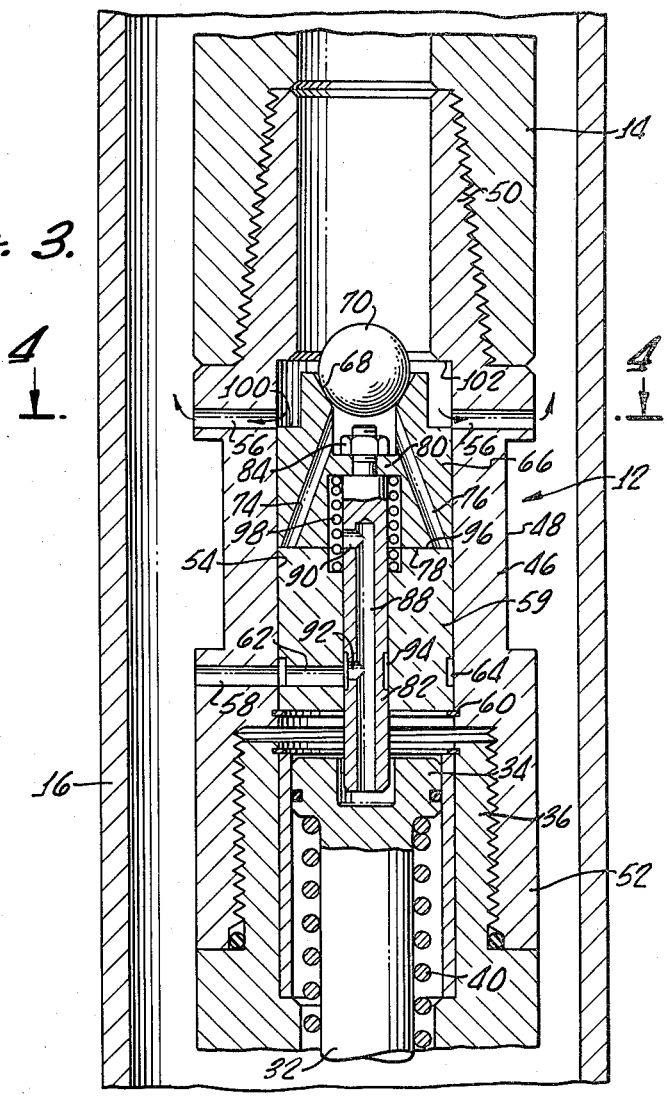
FIG. 4.
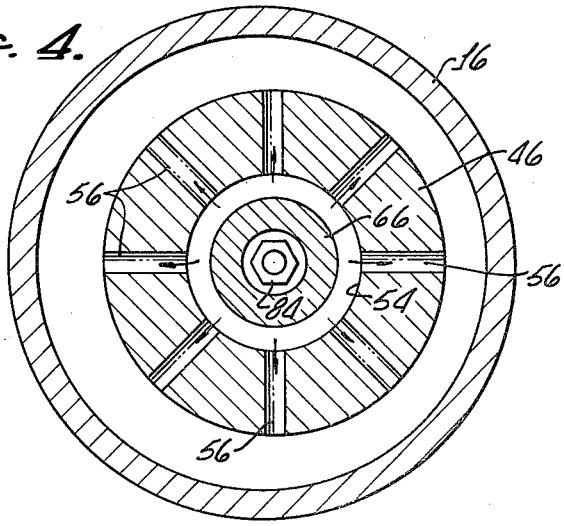

WATER WELL DEVELOPING SYSTEM

BACKGROUND OF THE INVENTION

The present invention relates to the development or clean-out of water wells and more particularly concerns such development and clean-out of a newly formed well that has just been perforated.

In many types of well drilling operations well casing is punctured at points below the ground and the openings thus formed must be cleared. In the drilling of water wells, for example, it is common practice to drive the well casing to a desired depth, at or beyond water bearing strata, and then to perforate the casing within the upper and lower boundaries of water bearing strata to provide for flow of water into the well casing.

After perforation of the well casing, the well must be developed, that is, sand and other debris must be driven from the casing perforations and such debris and other particles must be driven from the interior of the casing. Commonly after completion of the perforation the perforating tool is withdrawn from the well and an air-jet nozzle is then positioned within the well to accomplish well development. The withdrawal and subsequent insertion of tools from and into the well are difficult and time consuming processes and can add significantly to the cost, work and time involved in well completion.

U.S. Pat. No. 4,220,201 for Casing Perforator, issued to Earnest D. Hauk, one of the inventors of the present application, shows an air actuated water well casing perforator in which a perforating wheel is mounted on a pivoting arm that is driven into perforating position by an air cylinder and piston. With the wheel in position the entire perforator, by means of the drill string upon which it is mounted, is pulled upwardly to form the perforations. Air is supplied to the perforator actuating piston in this patent via a ball check valve arrangement that is mounted within the perforator piston. Differential pressure is employed in this patent to cause air to alternatively actuate the perforator or to be ejected through ports for well development and clean-out. Pressure below a predetermined amount, such as 80 pounds per square inch, is sufficient to actuate the perforator in this patent but not sufficient to disturb the normally closed check valve. Thus the lower pressure is used for the perforating operation. Higher pressures open the check valve and allow air to be discharged into the interior of the casing.

Although the perforator of the U.S. Pat. No. 4,220,201 effects perforation very satisfactorily, the ball check valve arrangement, designed for the purpose of selectively diverting air pressure for well clean-out purposes, has experienced many problems. It is difficult under field conditions, deep within a drilled well, to provide adequate control of the different pressures required for alternative operation of the perforator tool or the clean-out functions. Partly for this reason, the intended selectively alternative operation of casing perforation and well development is not accomplished satisfactorily with the arrangement of this patent. Further, the perforator may remain with its cutting wheel in cutting position during the desired well development and well clean-out so that is difficult to move the drill string and its assembled tooling within the well as may be desired during the application of the pressurized air for clean-out.

Accordingly, it is an object of the present invention to provide a well developing system that minimizes above-mentioned problems.

SUMMARY OF THE INVENTION

In carrying out principles of the present invention in accordance with a preferred embodiment thereof, well clean-out means is connected to and between a fluid operated tool and a supporting string of hollow drill pipe. The well clean-out means includes a clean-out body having ports for transmitting fluid from the drill pipe string to the interior of a casing in which the clean-out apparatus is positioned. The body has passage means for transmitting pressurized fluid to the tool and includes closure means for selectively blocking the clean-out ports. Provision is made for shifting the closure means so as to unblock the clean-out ports and means are provided for releasing fluid from the tool. More specifically, the clean-out body slidably carries a valve spool assembly that is spring urged to a tool operating position in which pressurized air from the drill string is readily transmitted to the tool. Provision is made to block the passage of air through the valve spool and shift the valve spool assembly into a position in which air from the drill string is transmitted through the clean-out body into the well casing and air or water from the tool is dumped. This is achieved by dropping a ball down through the drill string to seat upon and block the entrance to the valve spool passage.

BRIEF DESCRIPTION OF THE DRAWINGS

FIG. 3 is a fragmentary enlarged view of the developer and parts of the perforating tool in well clean-out position;

FIG. 4 is a section taken on lines 4—4 of FIG. 3; and

FIG. 5 schematically illustrates the system of FIGS. 1–4 and its well development operation.

DETAILED DESCRIPTION

Figure 1:
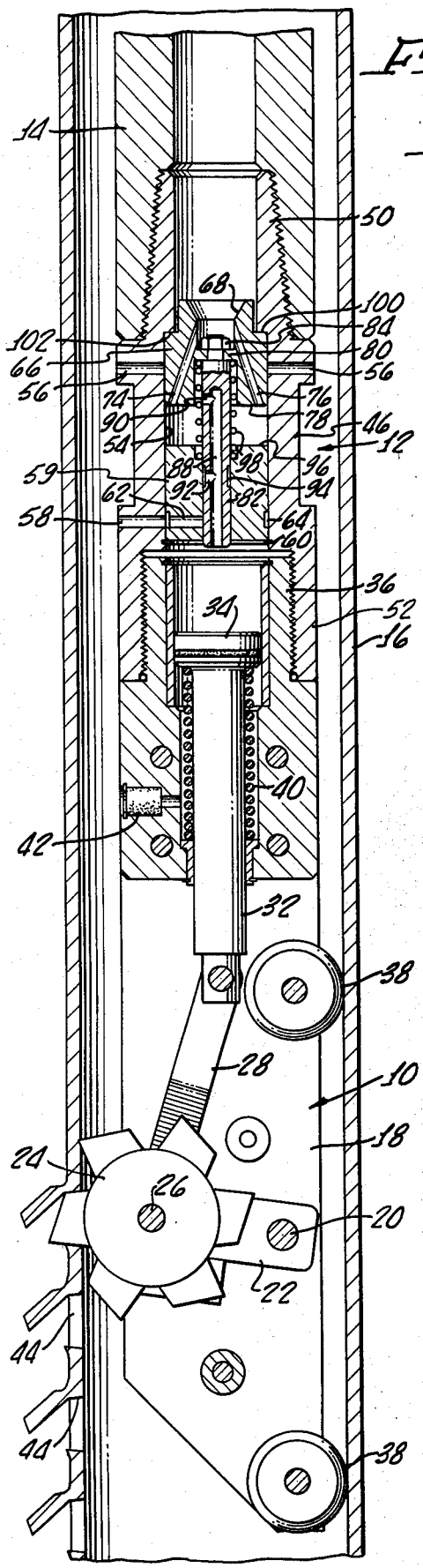
FIG. 1 illustrates a lower portion of a water well casing, showing a well developer embodying principles of the present invention in position between the lowermost end of a drill string and a perforating tool, with the tool in casing perforating position.
Figure 2:
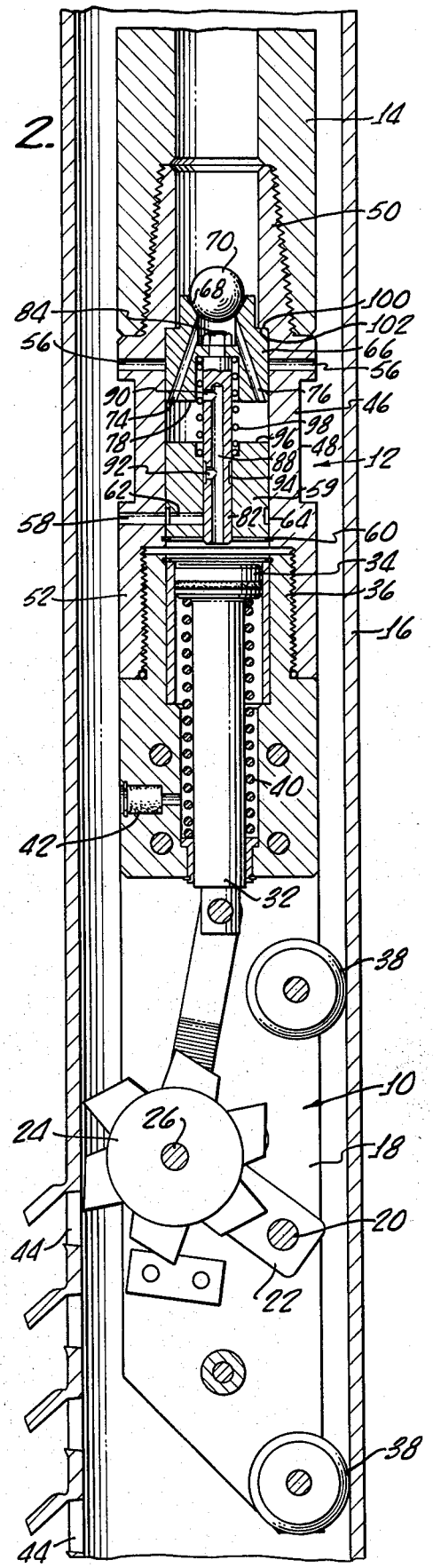
FIG. 2 shows the apparatus of FIG. 1 after the perforating tool has been released from its perforating position and with a developer actuating ball in position to cause the developer valve spool assembly to be driven downwardly.

Referring to FIGS. 1, 2 and 3, an air actuated casing perforator, generally indicated at 10, is carried at the lower end of a well developer 12 which in turn is fixed to the lower end of a string of drill pipe 14 that has been lowered into a casing 16 previously driven into the ground.

The perforator is substantially the same as the perforator of U.S. Pat. No. 4,220,201, and operates in the same manner. Briefly, the perforator comprises a pair of side walls 18 to which is pivoted at 20 a pivot arm 22 carrying a toothed wheel 24 journaled on the arm 22 at 26. The arm and wheel 22, 24 are swung between the operating or perforating position shown in FIG. 1 and the inoperable position of FIG. 2 by means of an actuator 28 connected between the pivot arm 22 and a vertically reciprocal perforator piston rod 32 fixed to a piston 34 that is slidable within a perforator air cylinder 36. The perforator is positioned with the casing by means of wheels 38 and actuator piston 34 is urged upwardly by means of a spring 40 circumscribing the piston rod 32. Air relief port 42 is provided in the cylinder 36 at the lower side of the piston. As described in greater detail in the above-mentioned patent, air under pressure, admitted to the cylinder 36 at the upper side of the piston 34, drives the latter downwardly causing the arm 22 and wheel 24 to pivot counterclockwise (as viewed in FIG. 1) about axis 20, whereupon the entire drill string and perforator tool are raised, causing the teeth of cutter wheel 24 to dig into and perforate the casing wall, with the wheel turning about its journal axis 26 as the apparatus is raised. This operation forms a vertical line of perforations 44 in the casing.

Relief of the pressure within the cylinder 36, above the piston, allows spring 40 to drive the piston upwardly and return the cutter wheel to deactivated position in which its teeth clear the interior of the casing wall.

In accordance with the present invention, the well developer 12 is interposed between the lower end of the drill string 14 and the perforating tool. The developer physically supports the tool from the drill string and, moreover, transmits pressurized air flowing from the surface through the drill string to the tool actuating cylinder 36. The developer performs the additional function of dumping water or air from the cylinder 36 as will be described more particularly below.

The developer is formed of a tubular housing or body 46 having tool receiving flats 48 on an intermediate section thereof, a male threaded tapered upper end fitting 50 integral with the body and a female threaded cylindrical lower end fitting 52 that threadedly receives the upper threaded end of the perforator tool cylinder 36. The upper end 50 of the developer housing is threadedly received in the lower end of the drill string 14 so that the developer tool fixedly supports the perforator tool from the drill string. The developer body has a right circular cylindrical bore 54 extending completely therethrough and a plurality of radially directed circumferentially spaced clean-out or air discharge ports 56 (see FIG. 4) extend from the bore to the exterior of the housing. A relief passage 58 extends through the housing 46 at a lower end thereof.

Fixedly mounted to and within a lower end of the bore 54 is a center block 59 held in place by a snap ring 60 and having a relief port 62 terminating at the outer end of block 59 in a circumferential groove 64 which is in registry with the housing relief port 58.

Slidably mounted within the bore 54 of the tubular housing 46 is a valve spool assembly including a valve piston 66 having a valve spool air passage extending therethrough. The air passage comprises a tapered opening at entrace 68 at the top of the piston forming a seat for a valve spool air passage closing ball 70 (see FIG. 2). The entrance connects with a plurality of downwardly and outwardly inclined passages 74, 76 which terminate at the lowermost end 78 of the piston. The lower end of the piston is formed with a downwardly opening central bore terminating at an intermediate part of the piston in a transverse web 80. An elongated valve spool stem 82 has its upper end received within the downwardly opening bore of the piston 66 and is secured thereto by means of a bolt 84 extending through the web 80 and threadedly received within the upper end of the valve stem 82. The latter is formed with a longitudinally extending blind axial passage 88 opening at the lower end of the stem and communicating at its upper end with a radial aperture 90 that extends through the wall of the stem. At an intermediate portion of the stem, between its lower end and aperture 90, is formed a relief opening 92 that provides fluid communication between the blind passage 88 and a circumferentially extending outwardly facing groove 94 formed in the outer surface of the stem 82.

Stem 82 extends slidably into and through an axial bore formed in block 59. This bore terminates in an upwardly facing enlargement at the upper surface 96 of the block. A spring 83 circumscribes stem 82 and seats at its lower end within the enlargement of the bore of block 59 and at its upper end within the downwardly facing bore of piston 66. The spring urges the piston to its uppermost position, shown in FIGS. 1 and 2, in which an upwardly facing piston shoulder 100 abuts a downwardly facing shoulder 102 formed on the upper end fitting of the housing 46.

In operation, the parts are assembled and inserted into the driven well casing until the perforator wheel 24 is at the desired position within the casing, the elevation at which the perforations are to be made. At this time ball 70 (FIGS. 2 and 3) is not inserted into the developer.

As previously mentioned, the perforator wheel 24 is moved from its inoperable to its perforating position by pressurization of the cylinder 36 to drive piston 34 downwardly. Air for this pressurization is provided via a fitting (not shown) at the top of the drill string and thence flows downwardly through the hollow drill string, through the hollow upper fitting 50 of the developer, through the conical entrance 68 of the piston passage, through the inclined piston passages 74, 76, into the space between the piston and the block 59, thence into the valve stem aperture 90, and through passage 88 into the upper end of the cylinder 36. This air pressure pivots arm 22 and cutter wheel 24 into a starting position to enable perforation to commence upon raising the drill string and attached devices. Thus the parts of the developer assume the position illustrated in FIG. 1. The perforations are made as previously mentioned and as described in full detail in U.S. Pat. No. 4,220,201. After the perforations have been completed, the well must be developed. In developing the well, air under pressure is injected into the interior of the casing in the vicinity of the perforations and thus blows sand and debris from the perforations and blows sand, debris and other particles upwardly around the drill string in the annular area between the interior of the casing and the exterior of the drill string as illustrated by the arrows in FIG. 5.

To achieve this well development, or clean out, air pressure is relieved at the upper end (not shown) of the drill string to allow the perforator tool parts to return, under the urging of spring 40, to the position illustrated in FIG. 2.

After release of the air pressure at the top of the drill string, the drill string is separated above the surface and ball 70, for the first time, is inserted into the interior of the drill string and allowed to fall through the drill string into the upper end of the developer. The ball seats itself upon the entrance 68 to the piston passage, thus blocking flow of air from the drill string into the upper end of the piston. It will be noted that with the piston in its upper position, clean-out ports 56 are blocked and sealed by the close fitting piston. Further, with the piston in this upper position, relief ports 58, 62 are sealed at the inner end of port 62 by the outer surface of the valve stem 82.

After the ball 70 has been seated upon the entrance aperture or seat 68 of the piston, the drill pipe is once again pressurized. The pressurized air can no longer flow to the perforator 10 through the piston 66 because of the ball 70. Accordingly the piston is driven downwardly against the force of the spring 98 to the clean-out or developing position illustrated in FIG. 3 in which the lower end of the piston seats upon the upper end of block 59. With the piston and stem in the position of FIG. 3, clean-out ports 56 are now unblocked and air under pressure from the interior of the drill string will readily pass through the clean-out ports into the interior of the casing to perform the well developing and clean-out action.

With the piston in the clean-out position of FIG. 3, pressure within the perforating tool itself is relieved. In the lower position of the valve spool stem, its relief opening 92, together with annular recess 64, is in registry with the relief openings 62 and 58 of block 59 and tubular housing 46. The lower end of the passage of the valve stem is in communication with the interior of perforator cylinder 36. Thus air or water within this cylinder can readily be dumped via the path including the stem passage 88, relief opening 92 and relief passage 58, 62, into the interior of the casing.

This dumping of air and water from the perforator tool cylinder is important, particularly in those cases where there may be residual air pressure within this cylinder or where water may fill the lower end of the casing about the perforating and developing apparatus. With water in the cylinder 36 the downward motion of the valve spool assembly, including piston and stem, may initially force the perforator tool piston 34 downwardly because of water that may be captured within the cylinder and the bore of the stem. However, as soon as the relief opening 92 becomes aligned with the relief passages 58, 62 this water is readily drained or dumped into the interior of the casing. This insures that the perforator tool will be in its inoperable position so that the entire apparatus may be moved vertically within the casing, either during the well development operation of upon its completion.

The foregoing detailed description is to be clearly understood as given by way of illustration and example only, the spirit and scope of this invention being limited solely by the appended claims.

What is claimed is:

1. Well forming and clean-out apparatus comprising a string of drill pipe adapted to be lowered into a well casing, a fluid operated tool carried by said drill pipe string and adapted to be operated within the well casing by fluid transmitted through the drill pipe string, and well clean-out means connected to and between said tool and drill pipe string and including a clean-out body, a plurality of clean-out ports in said body for transmitting pressurized fluid from said drill pipe string to the interior of a casing in which said well clean-out means is positioned, passage means in said body for transmitting pressurized fluid to said tool, said passage means including closure means for blocking said clean-out ports, means for shifting said closure means to unblock said ports, means responsive to said closure means for simultaneously releasing fluid from said tool, said closure means comprising a valve spool assembly slidably mounted in said body, said passage means including a valve spool passage formed in said valve spool assembly, said means for shifting said closure means comprising means for blocking an end of said valve spool passage, said valve spool assembly comprising a valve spool piston slidably mounted in said body between a first position in which it blocks said clean-out ports and a second position in which the clean-out ports are unblocked, said valve spool passage having an upper end open to an upper end of said body, said means for blocking an end of said passage comprising a ball adapted to seat upon said open upper end of said valve spool passage, said means for releasing fluid from said tool comprising a body relief port in said clean-out body and a valve spool stem having a passage connected to said piston and communicating with said tool, said stem having a relief port positioned to communicate with said stem passage and said body relief port.

2. Water well developer apparatus comprising a generally tubular body adapted to be connected at one end to a hollow drill string, and having a body bore, said tubular body having a plurality of circumferentially spaced clean-out ports extending therethrough, a valve spool piston slidably mounted within the body bore for motion between a first position in which said clean-out ports are blocked and a well developing position in which said clean-out ports are unblocked, said piston having an air passage extending therethrough, said passage having one end thereof terminating in a ball seat, a ball adapted to be seated on said ball seat to block flow of air through said piston whereby air under pressure admitted to said tubular body drives said piston along said bore to said well developing position in which said clean-out ports are unblocked, a perforator tool having an air cylinder connected to a lower end of said tubular body, said air passage being in communication with said air cylinder, a relief port in said body, and stem means connected with said piston for motion therewith to a first position in which said relief port is blocked, and a well developing position in which said air cylinder communicates with said relief port.

3. Water well developer apparatus comprising a generally tubular body adapted to be connected at one end to a hollow drill string, and having a body bore, said tubular body having a plurality of circumferentially spaced clean-out ports extending therethrough, a valve spool piston slidably mounted within the body bore for motion between a first position in which said clean-out ports are blocked and a well developing position in which said clean-out ports are unblocked, said piston having an air passage extending therethrough, said passage having one end thereof terminating in a ball seat, a ball adapted to be seated on said ball seat to block flow of air through said piston whereby air under pressure admitted to said tubular body drives said piston along said bore to said well developing position in which said clean-out ports are unblocked, including a body center block fixed to said tubular body within a lower end of said body bore, said block having a block bore extending therethrough, said tubular body having a relief port extending therethrough adjacent the lower end of said body bore, a valve spool stem fixed to said piston and extending through said block bore, said stem having an axially extending flow passage with one end thereof in communication with the passage in said valve spool piston and the other end thereof open to the lower end of said tubular body, said stem having a relief aperture extending radially therethrough into the passage of said stem, said stem being movable together with said valve spool piston from said first position to align said stem relief aperture with said relief port, a perforator tool having an air cylinder connected to the lower end of said tubular body, said valve spool stem being in fluid communication with the interior of said perforator tool air cylinder.

4. The apparatus of claim 3 wherein said passage through said valve spool piston comprises an uppermost central section in which said ball seat is formed and a plurality of downwardly and outwardly inclined passage legs extending through the piston to a lowermost surface thereof, said piston having a bore at a lower end thereof, an upper end of said valve spool stem being fixed to and within said piston bore, and a spring circumscribing said valve spool stem, positioned within said piston bore and abutting said piston and center block to urge the piston and center block away from one another toward said first position of said piston.

5. The apparatus of claim 3 wherein said stem relief aperture is blocked in said first position.

* * * * *